US005096237A

United States Patent [19]

Hötzl

[11] Patent Number: 5,096,237

[45] Date of Patent: Mar. 17, 1992

[54] MULTIPLE-BOLT DOOR LATCH

[75] Inventor: Manfred Hötzl, Graz, Austria

[73] Assignee: Roto Frank Eisenwarenfabrik Aktiengesellschaft, Kalsdorf bei Graz, Austria

[21] Appl. No.: 719,784

[22] Filed: Jun. 24, 1991

[30] Foreign Application Priority Data

Jun. 27, 1990 [AT] Austria ..... 1369/90

[51] Int. Cl.[5] ..... E05B 63/14

[52] U.S. Cl. ..... 292/34; 292/39; 292/DIG. 44

[58] Field of Search ..... 292/34, 341.14, DIG. 44, 292/39, 40

[56] References Cited

U.S. PATENT DOCUMENTS

| | | | |
|---|---|---|---|
| 2,010,461 | 8/1935 | Milligan | 292/341.14 X |
| 2,192,398 | 3/1940 | Devereaux | 292/341.14 X |
| 3,791,180 | 2/1974 | Doyle | 292/34 X |
| 4,183,563 | 1/1980 | Stevens | 292/34 |

*Primary Examiner*—Richard E. Moore
*Attorney, Agent, or Firm*—Herbert Dubno; Andrew Wilford

[57] ABSTRACT

A latch has a housing, a main bolt displaceable in the housing between a fully extended position projecting fully from the housing and a retracted position generally withdrawn into the housing, and a spring engaged between the main bolt and the housing for urging the main bolt with a predetermined spring force into the fully extended position. At least one secondary bolt is similarly displaceable relative to the housing between an extended and a retracted position. A lockout mechanism in the housing connected between the main bolt and the secondary bolt prevents the secondary bolt from being displaced from its withdrawn into its extended position except when the main bolt is in its fully extended position. The bolt is engageable in a keeper provided with a spring-loaded flap that inhibits the bolt from extending thereinto into its fully extended position and that normally retains it in an intermediate position.

8 Claims, 2 Drawing Sheets

MULTIPLE-BOLT DOOR LATCH

FIELD OF THE INVENTION

The present invention relates to a door latch. More particularly this invention concerns such a latch which operates several bolts to secure the door in several locations.

BACKGROUND OF THE INVENTION

A standard multiple bolt door latch has a main bolt that is spring loaded and that is received in a keeper at knob-level in the door jamb and one or more secondary bolts that engage in the door frame at other locations, typically in the lintel and sill. An actuating lever can be displaced in one direction, normally downward, to retract all the bolts and oppositely to extend the secondary bolts. The spring-loaded main bolt always projects from the door but can be deflected inward to hold it shut without actuation of the lever.

The advantage of this system is that for low-security latching of the door it is merely necessary to close it so that it is caught by the spring-loaded main bolt, and it can be opened easily by simply moving the lever down into its lower end position to retract this main bolt. For positive multipoint locking the lever is pulled up into its upper end position to extend the secondary bolt or bolts. The same downward actuation that retracts the main bolt will also, if necessary, retract the secondary bolt or bolts.

The main disadvantage is that if the handle is moved up when the door is open, the secondary bolts are extended. When the door is then closed, they can damage the door frame and scrape on the floor.

OBJECTS OF THE INVENTION

It is therefore an object of the present invention to provide an improved multibolt door latch.

Another object is the provision of such an improved multibolt door latch which overcomes the above-given disadvantages, that is which cannot extend its secondary bolt or bolts when the door is not closed.

SUMMARY OF THE INVENTION

A latch according to this invention has a housing, a main bolt displaceable in the housing between a fully extended position projecting fully from the housing and a retracted position generally withdrawn into the housing, and a spring engaged between the main bolt and the housing for urging the main bolt with a predetermined spring force into the fully extended position. At least one secondary bolt is similarly displaceable relative to the housing between an extended and a retracted position. A lockout mechanism in the housing connected between the main bolt and the secondary bolt prevents the secondary bolt from being displaced from its withdrawn into its extended position except when the main bolt is in its fully extended position. The bolt is engageable in a keeper provided with a spring-loaded flap that inhibits the bolt from extending thereinto into its fully extended position and that normally retains it in an intermediate position.

Thus with this arrangement the secondary bolt or bolts can only be extended when the door is closed and the main bolt is engaged in its keeper. When the door is open the main bolt will be fully extended and the secondary bolts will be prevented from being extended. Only when the door is closed and the main bolt is held in an intermediate position short of its fully extended position by the special keeper according to this invention can the secondary bolts be extended.

According to a feature of this invention the keeper includes a spring-loaded abutment that resists entry of the main bolt into the keeper with a predetermined spring force. The spring force of the abutment in the keeper is greater than the spring force of the spring in the housing.

Further more in accordance with the invention the lockout unit includes a slide longitudinally displaceable in the housing, formed with a laterally open seat, and connected to the bolts and a retaining element urged by the spring into the seat only in the retracted position of the secondary bolts. The retaining element is thus engaged by the main bolt and held out of the seat except in the fully extended position of the main bolt. The depth of the seat is at most as big as the length of the displacement of the main bolt between its intermediate and fully extended positions.

To ensure positive actuation of even the main bolt the latch according to this invention has a cam between the slide and the main bolt for displacing the main bolt into the keeper into the fully extended position on displacement of the secondary bolt into its extended position. This cam is an angled ramp formed on the slide and an abutment on the main bolt engageable by the ramp on longitudinal displacement of the slide.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
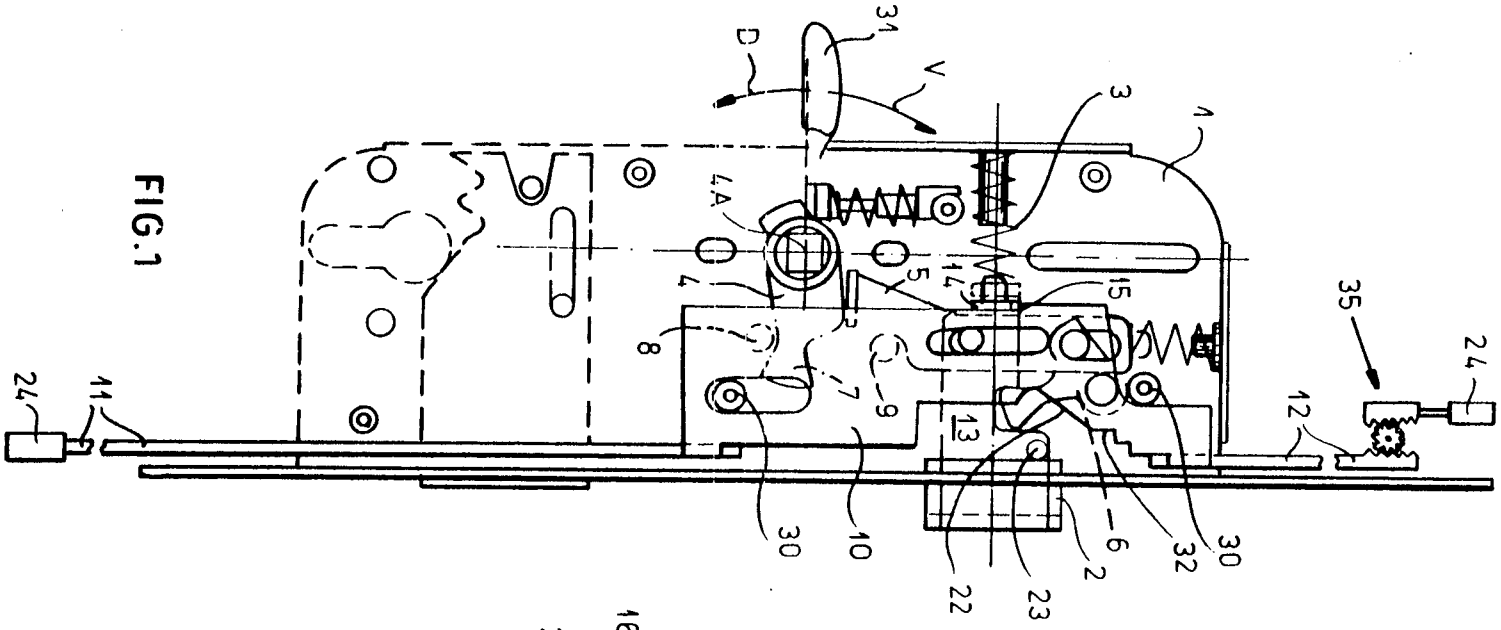
FIG. 1 is a partly diagrammatic vertical section through the latch according to this invention with the door open.
Figure 2:
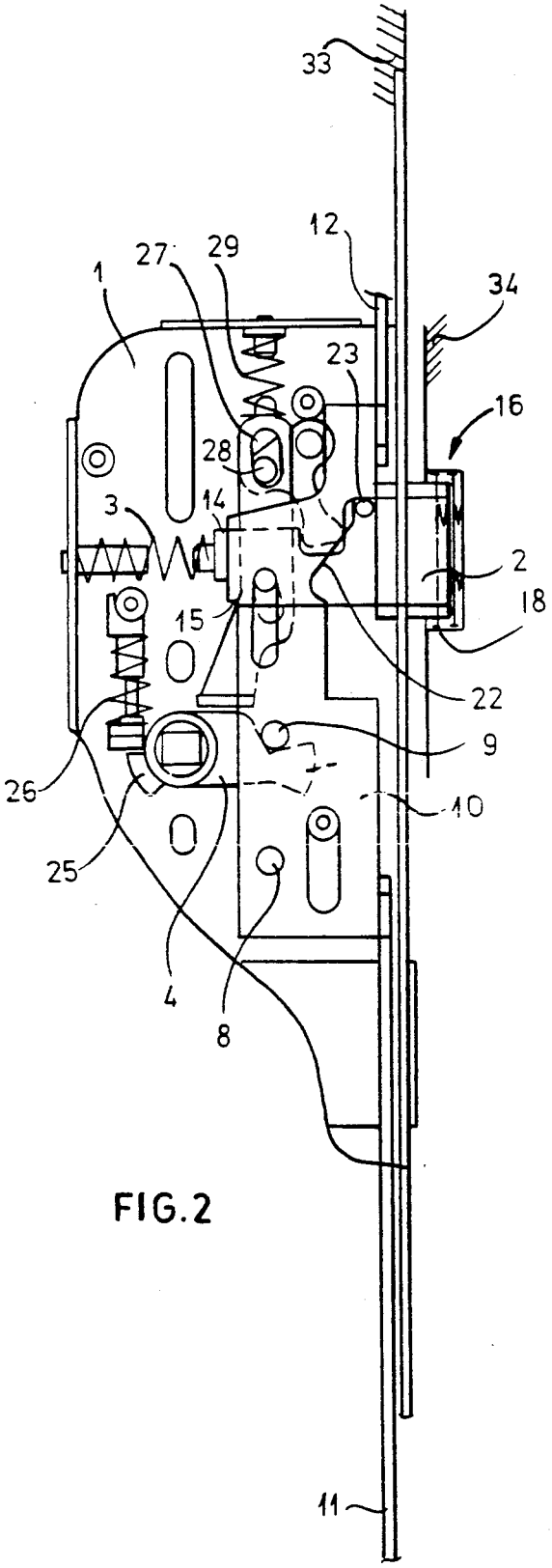
FIG. 2 is a section like FIG. 1 but showing the door closed and the secondary bolts extended.

As seen in FIGS. 1 and 2 a door latch according to this invention has a housing 1 normally mortised in or set on the free edge of a door 33 and having a bolt 2 having a body 13 and normally urged outward by a relatively weak spring 3 so as to project past the door edge. An actuator 4 is pivotal in the housing 1 by a handle 31 about an axis 4A and is urged into the illustrated position by a spring 26 braced against a lug 25 on the actuator 4. This actuator 4 has an arm 7 that can engage one end of a slide 5 formed with a slot 27 in which engages a pin 28 of another lever 6 engaging in an upwardly open notch formed in the body 13 of the bolt 2. The handle 31 is fitted into a square-section hole of the actuator 4 so that when it is pressed downward as indicated by arrow D it pushes the arm 7 up against the lower end of the element 5 so as to raise this element 5 against the force of a return spring 29, thereby pivoting the lever 6 clockwise and retracting the bolt 2 against the force of its spring 3. As the door 33 is shut the beveled end of the bolt 2 can be pushed inward against the force of the spring 3 without moving the actuator 4 due to the lost motion between the pin 28 and slot 27.

The latch also has a slide 10 guided for vertical longitudinal movement on two pins 30 seated in the housing 1 and connected to two rods 11 and 12 which are connected to respective secondary bolts such as shown at 24. it being noted that one of these bolts 24 must be connected to the respective rod 12 through a reversing mechanism 35 comprised of a fixed pinion and two racks. This slide 10 carries lower and upper abutments 8 and 9 that can be engaged by the actuator arm 7. When the slide 10 is moved downward as illustrated in FIG. 2 it extends the secondary bolts 24, and when raised as in FIG. 1, these bolts 24 are retracted into the door 33. In a prior-art system the slide 10 could be moved between its end positions in any position of the door or the other parts of the latch.

According to this invention a stop 14 is pressed by the spring 3 against the rear longitudinal edge of the slide 10, which edge is formed with a notch or seat 15 that can engage behind the stop 14 and prevent downward displacement of this slide 10. This stop 14 is also engageable by the rear end of the bolt body 13 to be pushed backward out of engagement with the slide 10 whenever the bolt 2 is not fully extended from the door 33 as seen in FIG. 1. In the fully extended position of FIG. 1 the stop 14 engages in the seat 15 and prevents the slide from being moved into the lower position in which it extends the bolts 24.

Figure 3:
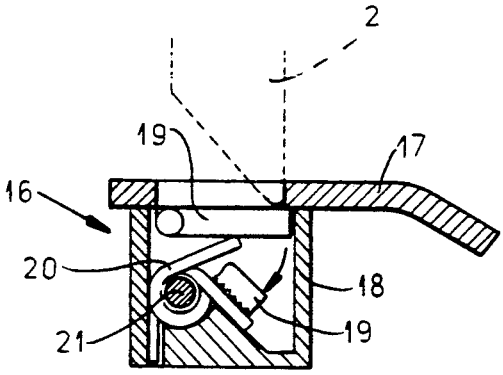
FIG. 3 is a horizontal section through the keeper according to the invention.
Figure 4:
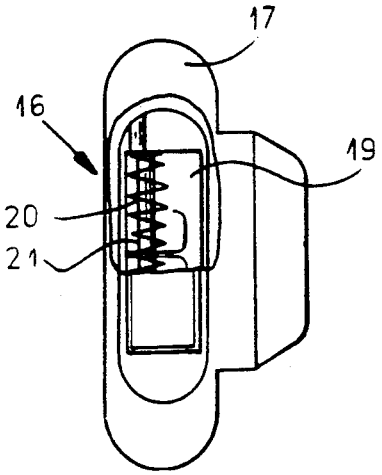
FIG. 4 is a small-scale partly broken-away side view of the keeper of FIG. 3.

As seen in FIGS. 3 and 4 a keeper 16 according to this invention is set in a door jamb 34 and has a strike plate 17 and a pocket 18 that are normally secured as is well known in the door jamb level with the bolt 2. The opening of the pocket 18 is normally blocked by a pivotal flap 19 that is held in a position blocking this opening by a spring 20 secured on a pivot rod 21 in the pocket 18. The resistance offered by the flap 19 to being deflected inward by the bolt 2 is substantially greater than the force that the spring 3 brings to bear to push the bolt 2 outward, however.

Thus with this system if the door 33 is simply shut, without any actuation of the lever 31 while the parts are in the FIG. 1 position, the bolt 2 will catch in the strike plate as shown in dashed lines in FIG. 3 and will retain the door shut, There will be, however, no significant holding for security purposes as the bolt 2 could easily be levered back into the housing 1 to open it. Once in this position, however, the body 13 of the bolt 2 is pushing the stop 14 back out of contact with the edge of the slide 10 so that the handle 31 can be lifted upward as shown by arrow U to extend the secondary bolts 24.

Furthermore according to this invention the front longitudinal edge of the slide 10 is formed with an inclined surface or ramp 22 that can engage a pin formation 23 on the bolt 2 when the slide 10 is levered downward into the lower end position. When the ramp 22 engages this formation 23 it cams the bolt 2 outward, thereby forcing it deep into the keeper 16 against the force of the spring 21. In this position the bolt 2 cannot be pushed back into the latch, as it is positively held in its outer position by engagement of the pin 23 against a flat edge 32 of the bolt 2. Forcing the door 33 in this position is therefore almost impossible as several different bolts 3 and 24 are positively extended at different locations into the jamb 34, and none of these bolts can simply be pushed back in against a spring force.

Thus with the latch according to the present invention when the door 33 is open it is impossible to extend its secondary bolts 24. Only when it is closed and the bolt 3 does not extend fully from the door edge can the secondary bolts 24 be extended, and this same action forcibly pushes out the main bolt 3 and retains it in the extended position. The latch therefore cannot be misused and when in use is highly effective.

I claim:

1. A latch comprising:

a housing;

a main bolt displaceable in the housing between a fully extended position projecting fully from the housing and a retracted position generally withdrawn into the housing;

means including a spring engaged between the main bolt and the housing for urging the main bolt with a predetermined spring force into the fully extended position;

at least one secondary bolt similarly displaceable relative to the housing between an extended and a retracted position;

lockout means in the housing connected between the main bolt and the secondary bolt for preventing the secondary bolt from being displaced from its withdrawn into its extended position except when the main bolt is in its fully extended position;

a keeper in which the bolt is engageable and into which it is extensible in its fully extended position; and means in the keeper for inhibiting the bolt from extending thereinto into its fully extended position and for normally retaining it in an intermediate position.

2. The latch defined in claim 1 wherein the means in the keeper is a spring-loaded abutment that resists entry of the main bolt into the keeper with a predetermined spring force.

3. The latch defined in claim 2 wherein the spring force of the means in the keeper is greater than the spring force of the spring in the housing.

4. The latch defined in claim 1 wherein the lockout means includes a slide longitudinally displaceable in the housing, formed with a laterally open seat, and connected to the bolts, and a retaining element urged by the spring into the seat only in the retracted position of the secondary bolts, the retaining element being engaged by the main bolt and held out of the seat except in the fully extended position of the main bolt.

5. The latch defined in claim 4 wherein the depth of the seat is at most as big as the length of the displacement of the main bolt between its intermediate and fully extended positions.

6. The latch defined in claim 4, further comprising cam means between the slide and the main bolt for displacing the main bolt into the keeper into the fully extended position on displacement of the secondary bolt into its extended position.

7. The latch defined in claim 6 wherein the cam means includes an angled ramp formed on the slide, and an abutment on the m in bolt engageable by the ramp on longitudinal displacement of the slide.

8. A latch comprising:

a housing;

a main bolt displaceable transversely in the housing between a fully extended position projecting fully from the housing and a retracted position generally withdrawn into the housing and through an intermediate position;

means including a spring engaged between the main bolt and the housing for urging the main bolt with a predetermined spring force into the fully extended position;

at least one secondary bolt similarly displaceable relative to the housing between an extended and a retracted position;

a slide displaceable longitudinally in the housing;

lockout means in the housing connected between the main bolt and the slide for preventing the secondary bolt from being displaced from its withdrawn into its extended position except when the main bolt is in its fully extended position;

a keeper in which the bolt is engageable and into which it is extensible in its fully extended position; and means in the keeper for inhibiting the bolt from extending thereinto into its fully extended position with a predetermined force greater than the spring force and for normally retaining the main bolt in an intermediate position.

* * * * *